US005282937A

United States Patent [19]

Miller et al.

[11] Patent Number: 5,282,937

[45] Date of Patent: Feb. 1, 1994

[54] USE OF ION CONDUCTORS IN THE PYROCHEMICAL REDUCTION OF OXIDES

[75] Inventors: William E. Miller, Naperville; Zygmunt Tomczuk, Lockport, both of Ill.

[73] Assignee: University of Chicago, Chicago, Ill.

[21] Appl. No.: 994,786

[22] Filed: Dec. 22, 1992

[51] Int. Cl.[5] ..... C25C 3/34

[52] U.S. Cl. ..... 204/64 R; 204/243 R; 204/68; 204/DIG. 4; 204/130; 204/1.5; 205/230

[58] Field of Search ..... 204/243 R, 64 R, 68, 204/DIG. 4, 130, 1.5; 205/230

[56] References Cited

U.S. PATENT DOCUMENTS 4,089,770 5/1978 Lemke ..... 204/68

4,804,448 2/1989 Sammells et al. ..... 204/243 R

*Primary Examiner*—John Niebling

*Assistant Examiner*—Patrick J. Igoe

*Attorney, Agent, or Firm*—Joan Pennington; Helen S. Cordell

[57] ABSTRACT

An electrochemical process and electrochemical cell for reducing a metal oxide are provided. First the oxide is separated as oxygen gas using, for example, a $ZrO_2$ oxygen ion conductor anode and the metal ions from the reduction salt are reduced and deposited on an ion conductor cathode, for example, sodium ion reduced on a $\beta$-alumina sodium ion conductor cathode. The generation of and separation of oxygen gas avoids the problem with chemical back reaction of oxygen with active metals in the cell. The method also is characterized by a sequence of two steps where an inert cathode electrode is inserted into the electrochemical cell in the second step and the metallic component in the ion conductor is then used as the anode to cause electrochemical reduction of the metal ions formed in the first step from the metal oxide where oxygen gas formed at the anode. The use of ion conductors serves to isolate the active components from chemically reacting with certain chemicals in the cell. While applicable to a variety of metal oxides, the invention has special importance for reducing CaO to Ca° used for reducing $UO_2$ and $PuO_2$ to U and Pu.

17 Claims, 1 Drawing Sheet

USE OF ION CONDUCTORS IN THE PYROCHEMICAL REDUCTION OF OXIDES

CONTRACTUAL ORIGIN OF THE INVENTION

The United States Government has rights in this invention pursuant to Contract No. W-31-109-ENG-38 between the U.S. Department of Energy and the University of Chicago as operators of Argonne National Laboratory.

BACKGROUND OF THE INVENTION

1. Field of the Invention

This invention relates to an electrochemical process and apparatus to disassociate metal oxides into oxygen and the metal or metals; and more particularly to a process and apparatus for electrochemical generation of metals or metals from metal oxides including ion conductors to isolate the activity at the electrodes from chemical reaction and the regeneration of the metal which acts to electrochemically displace the metal of the metal oxide.

2. Background of the Invention

A number of solid ion conductors have been developed recently. Solid ion conductors may be either anion or cation conductors; $ZrO_2$ is an example of the former, and $\beta$-alumina is an example of the latter. For the most part, these have been applied as sensors. Applications of these sensors include measuring parts per million of levels of oxygen in inert gases and the oxygen activity in molten steel. An example of a cation conductor used at high current density is the $\beta$-alumina used in the Na-S battery. The scientific principles for solid ion conductors are well established. Finding new conductors or using some modifications of known conductors for new applications such as for reducing metal oxides is an endeavor worthy of support.

When normal oxide reductions are carried out by pyrochemical means, a waste oxide byproduct is produced by the chemical combination of the reductant metal and metal oxide. The development of ion conductors and electrochemical metal oxide reduction systems which utilize the ion conductors could have wide application not only in the nuclear industry, but also in the metals production industry since the waste product can be easily regenerated producing an oxygen gas stream, which can be vented, and new reductant metal.

As used in the specification and appended claims, the terms metal oxide and reductant are defined as follows.

Metal oxide is the oxide of a metal from which the desired metal product is to be obtained. For example:

$$UO_2 \rightarrow U.$$

Reductant is the metal (a different metal) which chemically reacts with the metal oxide to produce reductant metal oxide and metal products. For example:

$$Ca_{(reductant)} + \tfrac{1}{2}UO_2 \rightarrow CaO + U_{(product)}.$$

Accordingly, it is an object of the present invention to provide an electrochemical process and an electrochemical cell for reducing a metal oxide using ion conductors.

It is another object of the invention to provide an improved electrochemical process and an electrochemical cell for reducing a metal oxide overcoming some of the disadvantages of known arrangements for reducing metal oxides.

It is another object of the invention to provide an electrochemical process and associated apparatus used to disassociate reductant metal oxides into oxygen and the reductant metal or metals, for example to generate Ca° from CaO, using ion conductors to isolate the activity at the electrodes from chemical reaction and the regeneration of the reductant metal which acts to chemically displace the metal of the metal oxide.

It is another object of the invention to use ion conductors applied in electrochemical processes to separate oxygen from the waste product and to regenerate the reductant metal for recycle.

It is another object of the invention to use ion conductors applied in electrochemical processes to clean up waste salts, for example, produced in the weapons program, which are contaminated with actinide oxides.

SUMMARY OF THE INVENTION

In brief, these and other objects and advantages of the invention are provided by an electrochemical process of converting reductant metal oxides where the oxide is converted to oxygen gas, using for example, a $ZrO_2$ oxygen ion conductor anode, and the reductant metal ion from the oxide remains unreduced and dissolves in the electrolyte, while a second metal ion in the electrolyte is discharged and deposited as metal on an ion conductor cathode, for example, a $\beta$-alumina sodium ion conductor cathode. The generation of oxygen and isolation of oxygen gas using the oxygen ion conductor avoids the problem of chemical back reaction with active metals present in the electrolyte. The method also is characterized by a sequence of two steps where an inert cathode electrode is inserted into the electrochemical cell in the second step and the second metal, isolated from the system by, for instance, a $\beta$-alumina sodium ion conductor, is used as the anode to cause electrochemical reduction of the metal ion formed in the first step from the metal oxide where oxygen gas formed at the anode. The use of ion conductors serves to isolate the active components from chemically reacting with certain chemicals in the cell. While applicable to a variety of metal oxides, the invention has special importance for regenerating CaO to Ca° used as a reductant for $UO_2$ and $PuO_2$.

DETAILED DESCRIPTION OF THE INVENTION

In accordance with the invention, an electrochemical process is used to disassociate reductant metal oxides into oxygen and the metal or metals, for example to generate Ca° from CaO, using ion conductors to isolate the activity at the electrodes from chemical reaction and the regeneration of the reductant metal which acts to chemically displace the metal of the metal oxide. It is understood that the use of $ZrO_2$ at the oxygen electrode is particularly important. With regard to the specifics of the reduction of CaO, the process could include the displacement of U and Pu in their oxides by $Ca^{\circ}$ and the separation of U and Pu from the electrolyte.

An example of the recovery of oxide waste using ion conductors in the process of the invention is described below for recovery of the oxide waste from the chemical reduction of $UO_2$-$PuO_2$. In the production of uranium-plutonium metal from their oxides, calcium metal in a molten salt is used as the reductant. Calcium oxide is formed. Both the calcium metal and the calcium oxide are soluble in the salt to some degree. This makes an electrochemical method feasible. The two-step process of the invention is best illustrated by FIGS. 1-2.

Figure 1:
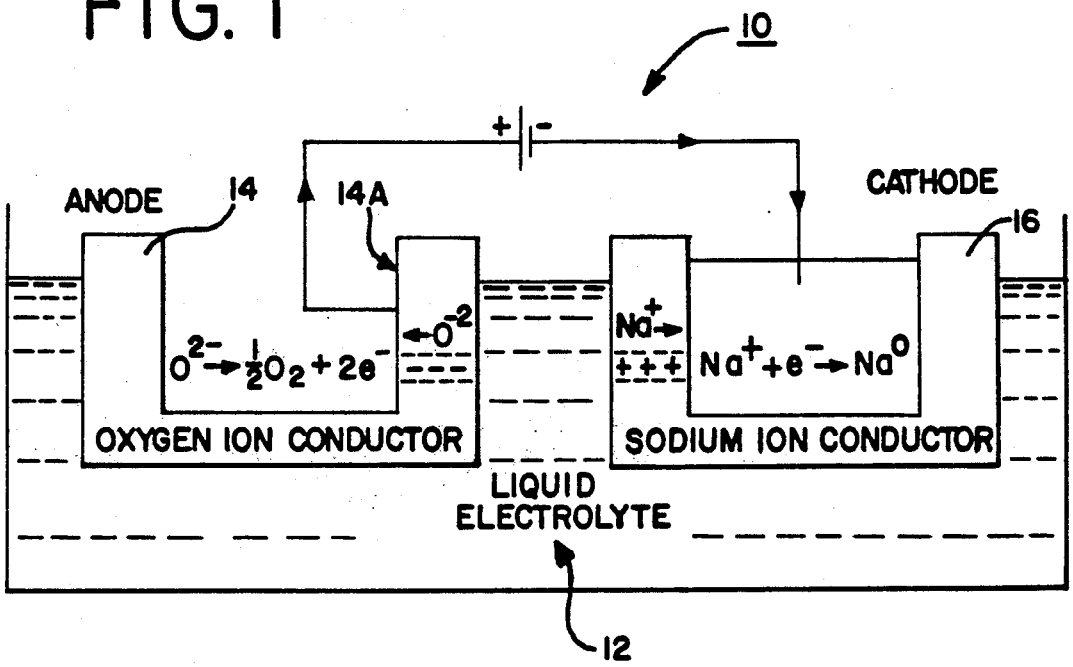
FIG. 1 is a schematic representation of an electrochemical cell using a first anode-cathode pair of ion conductor electrodes for performing a first step of the two step process of the invention.

In FIG. 1 there is shown an electrochemical cell generally designated by reference character 10 for carrying out a first step of the process of the invention. Initially, a liquid electrolyte 12 contains $Ca^{2+}$, $Na^{+}$, $Cl^{-}$, and $Ca^{\circ}$. An oxygen ion conductor anode 14, preferably a $ZrO_2$ anode 14, provides oxidation of $O^{-2}$ to $O^{\circ}$ at an inner surface 14A and gives rise to an $O^{-2}$ concentration gradient across this ionic conductor. An ion conductor cathode 16, such as, for example, a $\beta$-alumina sodium ion cathode 16, provides reduction of $Na^{+}$and gives rise to an $Na^{+}$concentration gradient across this ionic conductor. A cell voltage of about 2.8 volt is required with a current flow from the anode 14 to the cathode 16 of the first step of the process forms $Na^{\circ}$, $CaCl_2$ and $O_2$ and removes $O^{-2}$ and $Na^{+}$.

Figure 2:
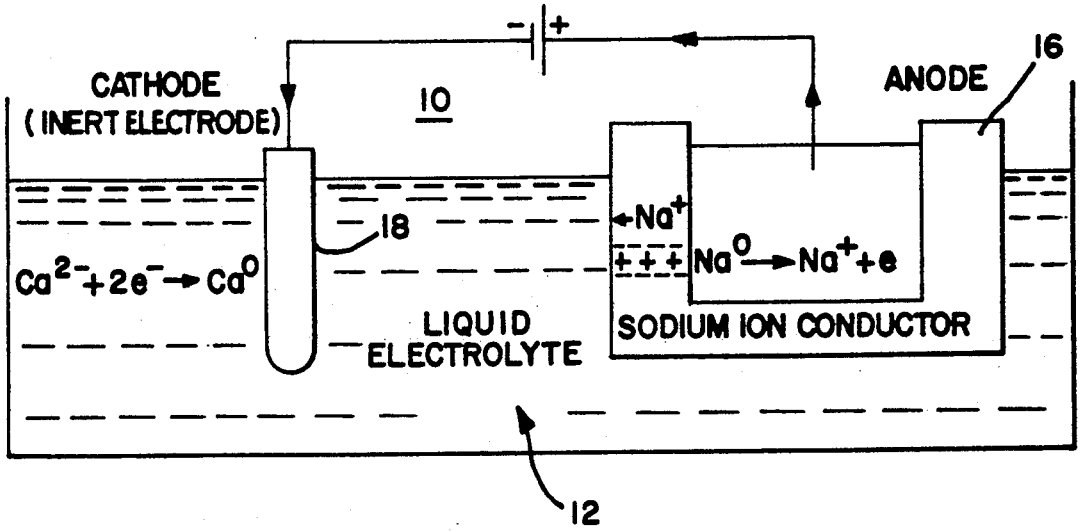
FIG. 2 is a schematic representation of the electrochemical cell using an inserted inert electrode with the first cathode ion conductor electrode serving as an anode for performing a second step of the two step process of the invention.

FIG. 2 illustrates the second step of the process of the invention with an inert cathode electrode 18 inserted into the cell 10 and current flow reversed from the cathode 16 now operating as an anode to the cathode electrode 18. $Ca^{\circ}$ is regenerated using the inert cathode electrode 18 and $Na^{+}$is regenerated at anode 16 in step 2 of the process. A cell voltage of about 0.02 volts is generated in step 2 of the process.

EXAMPLE 1

| Step 1 - $O_2$ Separation | | |
|---|---|---|
| Anode | Cell Electrolyte | Cathode |
| $ZrO_2$, oxygen ion conductor | Reduction salt containing soluble $Ca^{\circ}$, CaO, and added NaCl | Na in $\beta$-alumina sodium ion conductor |
| $CaO \rightarrow Ca^{2+} + \frac{1}{2} O_2 + 2e^{-}$ | | $NaCl + e^{-} \rightarrow Na^{\circ} + Cl^{-}$ |
| $Ca^{2+} + 2Cl^{-} \rightarrow CaCl_2$ | | |

Step 1 produces: Na metal, $CaCl_2$, and $O_2$ which is purged from the cell. Overall cell reaction is:

$$CaO + 2NaCl \rightarrow CaCl_2 + 2Na^{\circ} + \tfrac{1}{2}O_2$$

| Step 2 - Salt Regeneration | | |
|---|---|---|
| Anode | Cell Electrolyte | Cathode |
| Na in $\beta$-alumina $Na^{\circ} \rightarrow Na^{+} + e^{-}$ | Reduction salt containing soluble $Ca^{\circ}$, CaO, and added NaCl | Iron Rod $CaCl_2 + 2e^{-} \rightarrow Ca^{\circ} + 2Cl^{-}$ $CaCl_2 \rightarrow Ca^{\circ} + 2Cl^{-}$ |

Step 2 produces: $Ca^{\circ}$, NaCl.

Overall cell reaction is: $2Na^{\circ} + CaCl_2 \rightarrow 2NaCl + Ca^{\circ}$

The sum of the two steps converts CaO to calcium metal, which is recycled, and oxygen, which is purged from the system in Step 1 of FIG. 1. The calcium metal is the original reductant used to reduce the actinide oxides. The cell 10 in FIGS. 1 and 2 illustrates the two-step process and the operation of ion conductors 14, 16 and 18 in the electrochemical cell.

It should be understood that a separate step for the reduction of the $UO_2$-$PuO_2$ may not be needed. This can be illustrated by modification of the system discussed above, as provided by the following example:

EXAMPLE 2

| Step 1 - $UO_2/PuO_2$ Reduction and $O_2$ Separation | | |
|---|---|---|
| Anode | Cell Electrolyte | Cathode |
| $ZrO_2$, oxygen ion conductor | Salt containing soluble $Ca^{\circ}$, CaO NaCl, and contacting $UO_2$-$PuO_2$ | $Na^{\circ}$ or $Na^{\circ}$ alloy in $\beta$-alumina sodium ion conductor |
| $CaO \rightarrow Ca^{2+} + \frac{1}{2} O_2 + 2e^{-}$ | | $NaCl + e^{-} \rightarrow Na^{\circ} + Cl^{-}$ |
| $Ca^{2+} + 2Cl^{-} \rightarrow CaCl_2$ | | |

Step 1 produces: Na metal, $CaCl_2$, and $O_2$ which is purged from the cell.

Overall cell reaction for the above step is:

$$\begin{array}{l} UO_2 + 2Ca^{\circ} \longrightarrow 2CaO + U \\ + CaO + 2NaCl \longrightarrow CaCl_2 + 2Na^{\circ} + \tfrac{1}{2}O_2 \\ \hline UO_2 + 2Ca^{\circ} + 4NaCl \longrightarrow U^{\circ} + 2CaCl_2 + 4Na^{\circ} + O_2 \end{array}$$

| Step 2 - Salt Regeneration | | |
|---|---|---|
| Anode | Cell Electrolyte | Cathode |
| Na in $NaAlO_2$ $Na^{\circ} \rightarrow Na^{+} + e^{-}$ | Reduction salt containing soluble $Ca^{\circ}$, CaO, and added NaCl | Iron Rod $Ca^{2+} + 2e^{-} \rightarrow Ca^{\circ}$ $CaCl_2 \rightarrow Ca^{\circ} + 2Cl^{-}$ |

Step 2 produces: $Ca^{\circ}$, NaCl.

Overall cell reaction is $2Na^{\circ} + CaCl_2 \rightarrow 2NaCl + Ca^{\circ}$

It should be understood that an actinide oxide reduction system similar to the above examples and with the illustrated system of FIGS. 1 and 2, except based on lithium/lithium salts, is also theoretically possible. Its potential advantage over the calcium/calcium salt system is a lower operating temperature.

Also, a potential payoff of the process of the invention is that the oxide reduction can be a substantially continuous or semi-continuous operation, so that the oxide waste can be destroyed as it is generated.

Obviously many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electrochemical process of reducing a metal oxide comprising the steps of:

providing an electrochemical cell including a first anode-cathode pair of ion conductor electrodes and an electrolyte containing a molten salt which is comprised of a reductant, a reductant oxide and NaCl and the metal oxide, both said anode and said cathode of said first anode-cathode pair having an inner surface and an outer surface and only said outer surface being in contact with said electrolyte; said cathode being a sodium ion selective cathode and said anode being an oxygen ion selective anode;

impressing a voltage across said sodium ion selective cathode and said oxygen ion selective anode whereby $Na^{30}$ cations migrate from said electrolyte to an inner surface of said cathode to be reduced into $Na^{\circ}$ and $O^{-2}$ anions migrate from said electrolyte to an inner surface of said anode to be oxidized to $O_2$ with the reduction of the metal oxide to form metal and reductant chloride;

inserting an inert electrode into the electrochemical cell; and generating a voltage between said sodium ion selective cathode and said inserted inert electrode whereby said reductant is regenerated into said electrolyte.

2. An electrochemical process as recited in claim 1 wherein the metal oxide is an oxide of U or Pu.

3. An electrochemical process as recited in claim 1 wherein said molten salt contains soluble $Ca^{\circ}$, CaO and NaCl.

4. An electrochemical process as recited in claim 3 wherein said regenerated reductant includes $Ca^{\circ}$.

5. An electrochemical process as recited in claim 1 wherein said step of impressing a voltage across said sodium ion selective cathode and said oxygen ion selective anode includes applying a cell voltage of approximately 2.8 volts.

6. An electrochemical process as recited in claim 1 wherein said step of generating a voltage between said sodium ion selective cathode and said inserted inert electrode includes generation of a cell voltage of approximately 0.02 volts.

7. An electrochemical process as recited in claim 1 wherein said sodium ion selective cathode is a $\beta$-alumina sodium ion conductor.

8. An electrochemical process as recited in claim 1 wherein said oxygen ion selective anode is a $ZrO_2$ oxygen ion conductor.

9. An electrochemical process as recited in claim 1 wherein said molten salt includes calcium metal and said metal oxide includes an actinide oxide.

10. An electrochemical process as recited in claim 1 wherein said molten salt includes calcium metal and said metal oxide includes an oxide of uranium or plutonium.

11. An electrochemical process as recited in claim 1 wherein said molten salt includes lithium metal and lithium chloride and said metal oxide includes an actinide oxide.

12. An electrochemical cell for reducing a metal oxide from an electrolyte containing a molten salt which is comprised of a reductant, a reductant oxide and NaCl and the metal oxide; said electrochemical cell comprising:

a first anode-cathode pair of ion conductor electrodes; both said anode and said cathode of said first anode-cathode pair having an inner surface and an outer surface and only said outer surface being in contact with said electrolyte; said cathode being a sodium ion selective cathode and said anode being an oxygen ion selective anode;

means for impressing a voltage across said sodium ion selective cathode and said oxygen ion selective anode whereby $Na^{+}$ cations migrate from said electrolyte to an inner surface of said cathode to be reduced into $Na^{\circ}$ and $O^{-2}$ anions migrate from said electrolyte to an inner surface of said anode to be oxidized to $O_2$ with the reduction of the metal oxide to form metal and reductant chloride;

an inert electrode for insertion into the electrochemical cell; and means for generating a voltage between said sodium ion selective cathode and said inserted inert electrode whereby said reductant is regenerated into said electrolyte.

13. An electrochemical cell as recited in claim 12 wherein said oxygen ion selective anode is a $ZrO_2$ oxygen ion conductor.

14. An electrochemical cell as recited in claim 12 wherein said sodium ion selective cathode is a $\beta$-alumina sodium ion conductor.

15. An electrochemical cell as recited in claim 12 wherein said molten salt includes lithium metal and lithium chloride and said metal oxide includes an actinide oxide.

16. An electrochemical cell as recited in claim 12 wherein said molten salt includes calcium metal and calcium chloride and said metal oxide includes an actinide oxide.

17. An electrochemical cell as recited in claim 12 wherein said metal oxide includes an actinide oxide, an oxide of U or Pu and said molten salt includes $Ca^{\circ}$, CaO and NaCl.

* * * * *

UNITED STATES PATENT AND TRADEMARK OFFICE

CERTIFICATE OF CORRECTION

PATENT NO. : 5,282,937

DATED : February 1, 1994

INVENTOR(S) : Miller et al.

It is certified that error appears in the above-identified patent and that said Letters Patent is hereby corrected as shown below:

In claim 1, column 5, line 8, "$Na^{30}$" should be changed to --$Na^{+}$--.

Signed and Sealed this

Thirty-first Day of May, 1994

*Attest:*

*Attesting Officer*

BRUCE LEHMAN

*Commissioner of Patents and Trademarks*